US012637309B2

(12) United States Patent
Tran

(10) Patent No.: US 12,637,309 B2
(45) Date of Patent: May 26, 2026

(54) SHEET FEEDING TRAY WITH PAIR OF SIDE CURSORS, AND IMAGE FORMING APPARATUS

(71) Applicant: KYOCERA Document Solutions Inc., Osaka (JP)

(72) Inventor: Anh Viet Tran, Osaka (JP)

(73) Assignee: KYOCERA Document Solution Inc., Osaka (JP)

( * ) Notice: Subject to any disclaimer, the term of this patent is extended or adjusted under 35 U.S.C. 154(b) by 51 days.

(21) Appl. No.: 18/803,510

(22) Filed: Aug. 13, 2024

(65) Prior Publication Data

US 2025/0066151 A1 Feb. 27, 2025

(30) Foreign Application Priority Data

Aug. 23, 2023 (JP) ..... 2023-135614

(51) Int. Cl.
*B65H 1/04* (2006.01)
*B65H 9/04* (2006.01)

(52) U.S. Cl.
CPC ..... *B65H 1/04* (2013.01); *B65H 9/04* (2013.01); *B65H 2403/411* (2013.01); *B65H 2405/114* (2013.01); *B65H 2405/141* (2013.01); *B65H 2511/12* (2013.01)

(58) Field of Classification Search
CPC ..... B65H 1/04; B65H 9/04; B65H 2403/41; B65H 2403/411; B65H 2405/111; B65H 2405/114; B65H 2405/11425; B65H 2405/1144; B65H 2405/141; B65H 2511/12
See application file for complete search history.

(56) References Cited

U.S. PATENT DOCUMENTS 8,844,925 B1 * 9/2014 Chiu ..... B65H 1/04 271/240
2007/0138737 A1 * 6/2007 Yamada ..... B65H 1/04 271/171
2010/0061790 A1 * 3/2010 Yu ..... B41J 11/0025 400/613
2016/0122142 A1 5/2016 Okada et al.

FOREIGN PATENT DOCUMENTS

JP 2016088629 A 5/2016

* cited by examiner

*Primary Examiner* — Prasad V Gokhale

(74) *Attorney, Agent, or Firm* — IP Business Solutions, LLC.

(57) ABSTRACT

An image forming apparatus includes a sheet feeding tray. The sheet feeding tray includes a table, a pair of side cursors, a pair of rack gears, a pinion gear, a rotation shaft, and a biasing member. On the table, a sheet to be supplied in a predetermined sheet feeding direction is placed. The pair of side cursors are supported by the table, so as to move in a width direction intersecting the sheet feeding direction. The pair of rack gears are respectively fixed to the pair of side cursors, and extend in the width direction. The pinion gear is meshed with the pair of rack gears. The rotation shaft is fixed to the table, and rotatably supports the pinion gear, the rotation shaft being elastically deformable. The biasing member biases the rotation shaft in a direction for contacting the pinion gear.

7 Claims, 10 Drawing Sheets

SHEET FEEDING TRAY WITH PAIR OF SIDE CURSORS, AND IMAGE FORMING APPARATUS

INCORPORATION BY REFERENCE

This application claims priority to Japanese Patent Application No. 2023-135614 filed on Aug. 23, 2023, the entire contents of which are incorporated by reference herein.

BACKGROUND

The present disclosure relates to a sheet feeding tray including side cursors that align a sheet in a width direction, and an image forming apparatus.

A sheet feeding tray provided in an image forming apparatus includes a pair of side cursors, configured to move in the width direction intersecting the sheet feeding direction, to thereby align the sheet. The pair of side cursors are, in general, supported by a table of the sheet feeding tray, so as to be moved in opposite directions in synchronization with each other, by a rack-and-pinion mechanism.

SUMMARY

The disclosure proposes further improvement of the foregoing techniques.

In an aspect, the disclosure provides a sheet feeding tray including a table, a pair of side cursors, a pair of rack gears, a pinion gear, a rotation shaft, and a biasing member. On the table, a sheet to be supplied in a predetermined sheet feeding direction is placed. The pair of side cursors are supported by the table, so as to move in a width direction intersecting the sheet feeding direction. The pair of rack gears are respectively fixed to the pair of side cursors, and extend in the width direction. The pinion gear is meshed with the pair of rack gears. The rotation shaft is fixed to the table, and rotatably supports the pinion gear, the rotation shaft being elastically deformable. The biasing member biases the rotation shaft in a direction for contacting the pinion gear.

In another aspect, the disclosure provides an image forming apparatus including a document transport unit, an image reading unit, and an image forming unit. The document transport unit includes the foregoing sheet feeding tray and picks up the sheet from the sheet feeding tray and transports the sheet. The image reading unit reads an image of the sheet transported by the document transport unit. The image forming unit forms an image on a basis of the image read by the image reading unit.

DETAILED DESCRIPTION

Hereafter, a sheet feeding tray and an image forming apparatus according to an embodiment of the disclosure will be described, with reference to the drawings.

Figure 1:
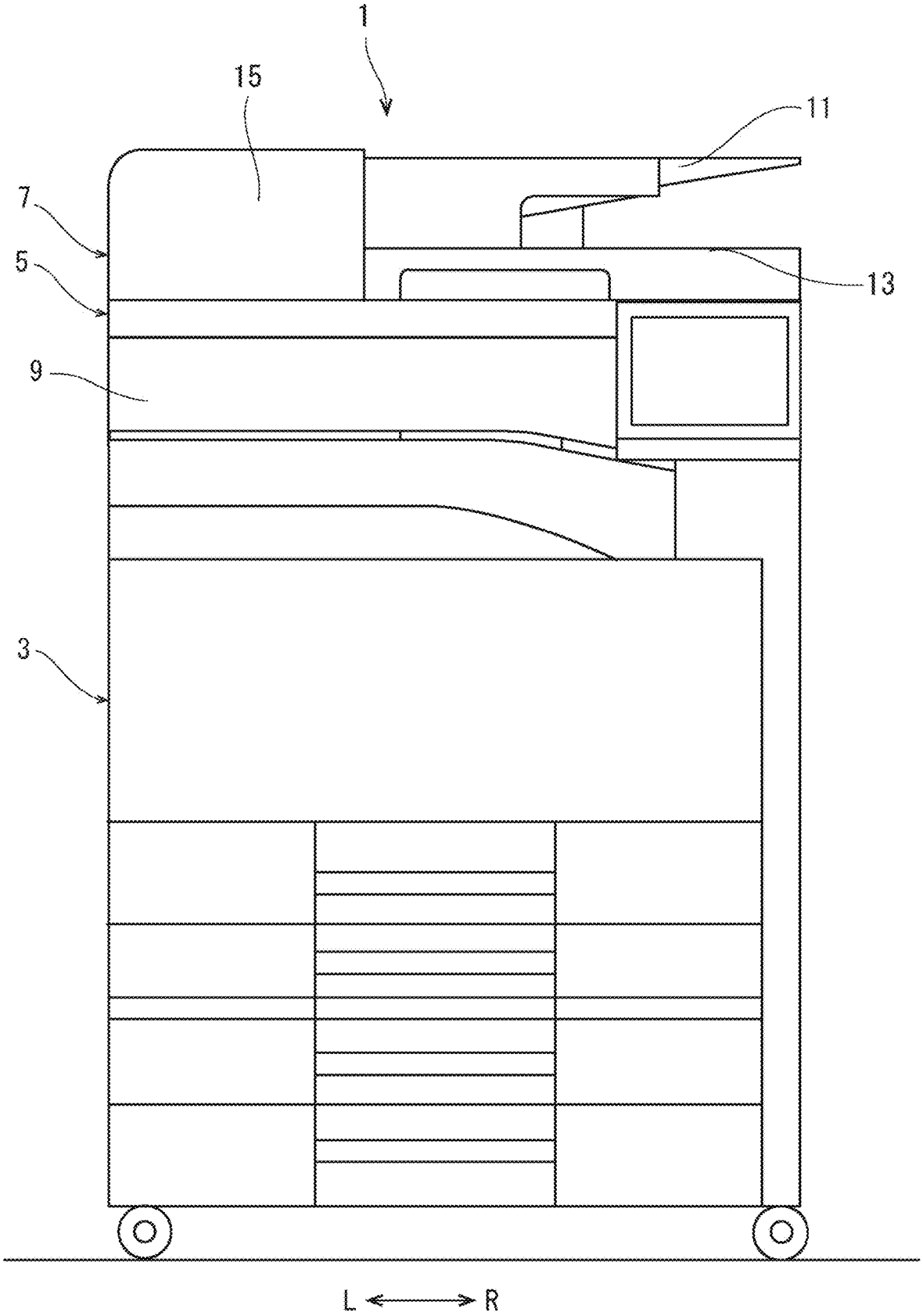
FIG. 1 is a front view showing an image forming apparatus according to an embodiment of the disclosure.

Referring first to FIG. 1, the image forming apparatus 1 according to the embodiment will be described. FIG. 1 is a front view showing the image forming apparatus 1. The reference codes Fr, Rr, L, R, Lo, and U in the drawings respectively represent the front side, rear side, left side, right side, lower side, and upper side of the image forming apparatus 1 shown in FIG. 1.

The image forming apparatus 1 includes an image forming unit 3, an image reading unit 5 located on the upper side of the image forming unit 3, and a document transport unit 7 located on the upper side of the image reading unit 5. Between the image forming unit 3 and the image reading unit 5, an inner delivery space 9 is defined.

The document transport unit 7 includes a sheet feeding tray 11 on which a document is placed, a discharge tray 13 located on the lower side of the sheet feeding tray 11, and a transport device 15 having a laid-down U-shaped transport route through which the document is transported from the sheet feeding tray 11 to the discharge tray 13. The document placed on the sheet feeding tray 11 is supplied to the transport device 15, and transported along the transport route. During this process, the image of the document is read by the image reading unit 5. The document, from which the image has been read, is delivered from the transport device 15 to the discharge tray 13, thus to be placed thereon. The image forming unit 3 forms an image on a sheet, on the basis of the image read by the image reading unit 5.

Figure 2:
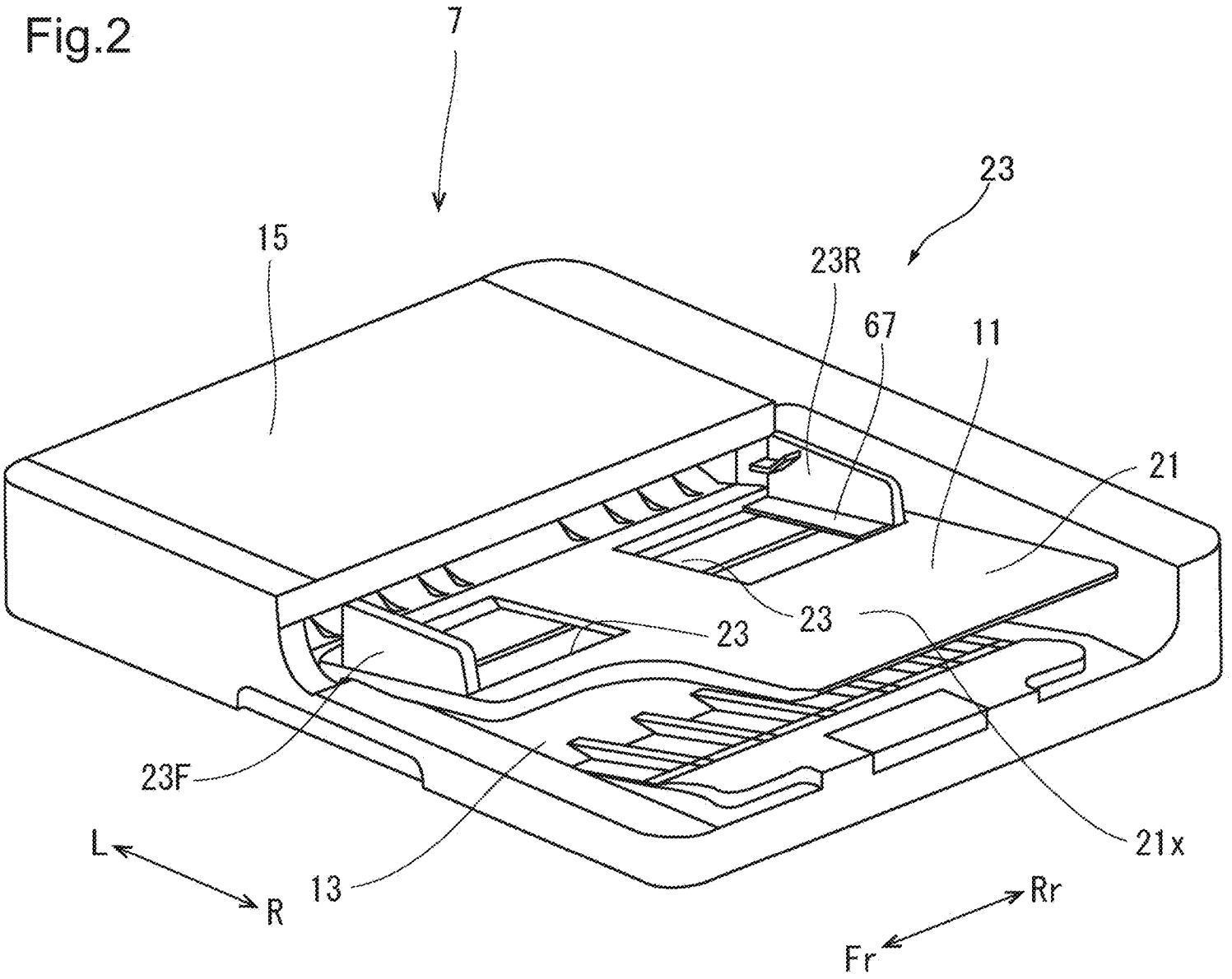
FIG. 2 is a perspective view showing a document transport unit of the image forming apparatus according to the embodiment of the disclosure.

Referring to FIG. 2, the document transport unit 7 will be described in further detail. FIG. 2 is a perspective view showing the document transport unit 7. As described above, the document transport unit 7 includes the sheet feeding tray 11, the discharge tray 13, and the transport device 15.

Figure 3:
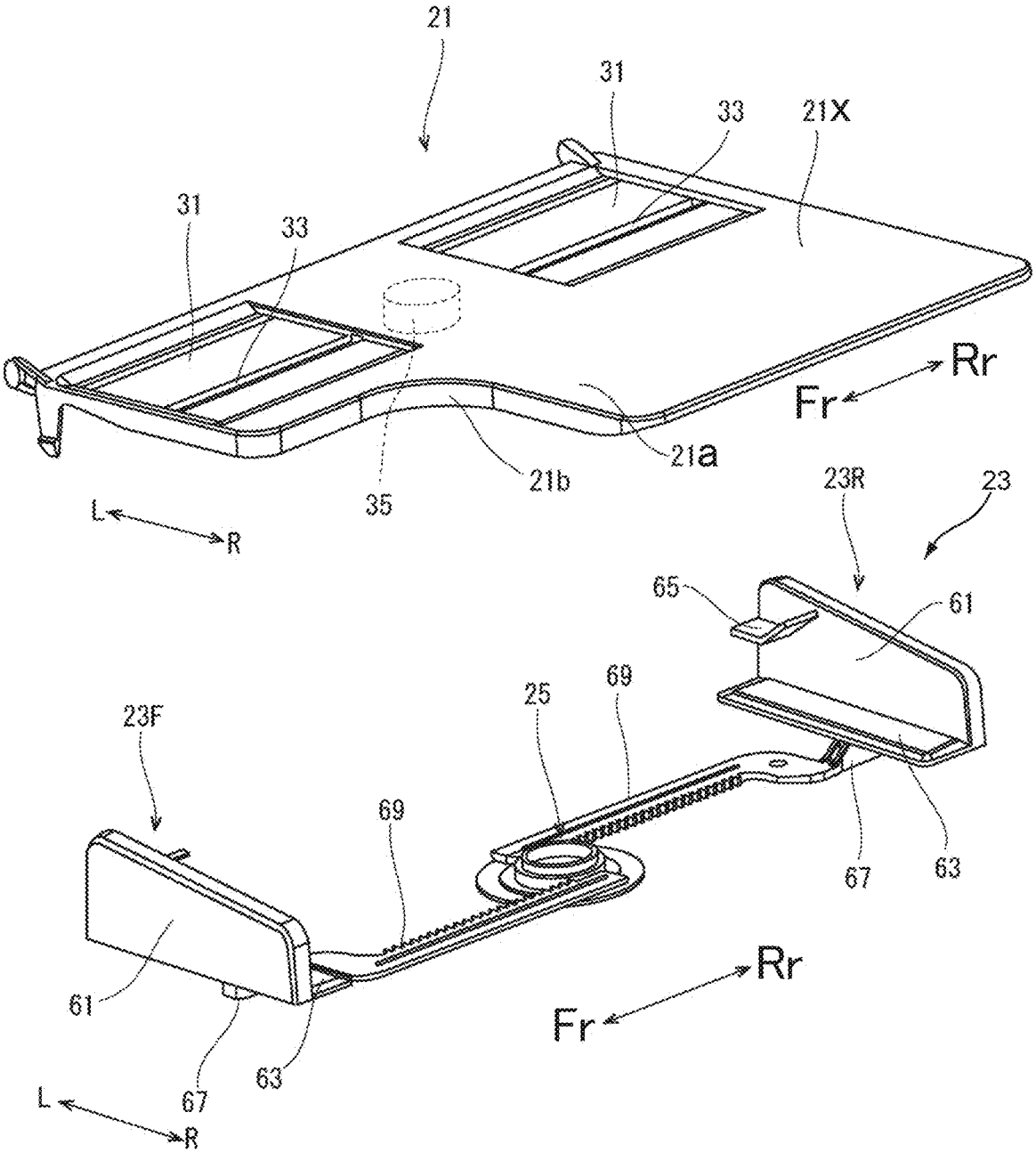
FIG. 3 is an exploded perspective view showing a table and a pair of side cursors of a sheet feeding tray according to the embodiment of the disclosure.
Figure 4A:
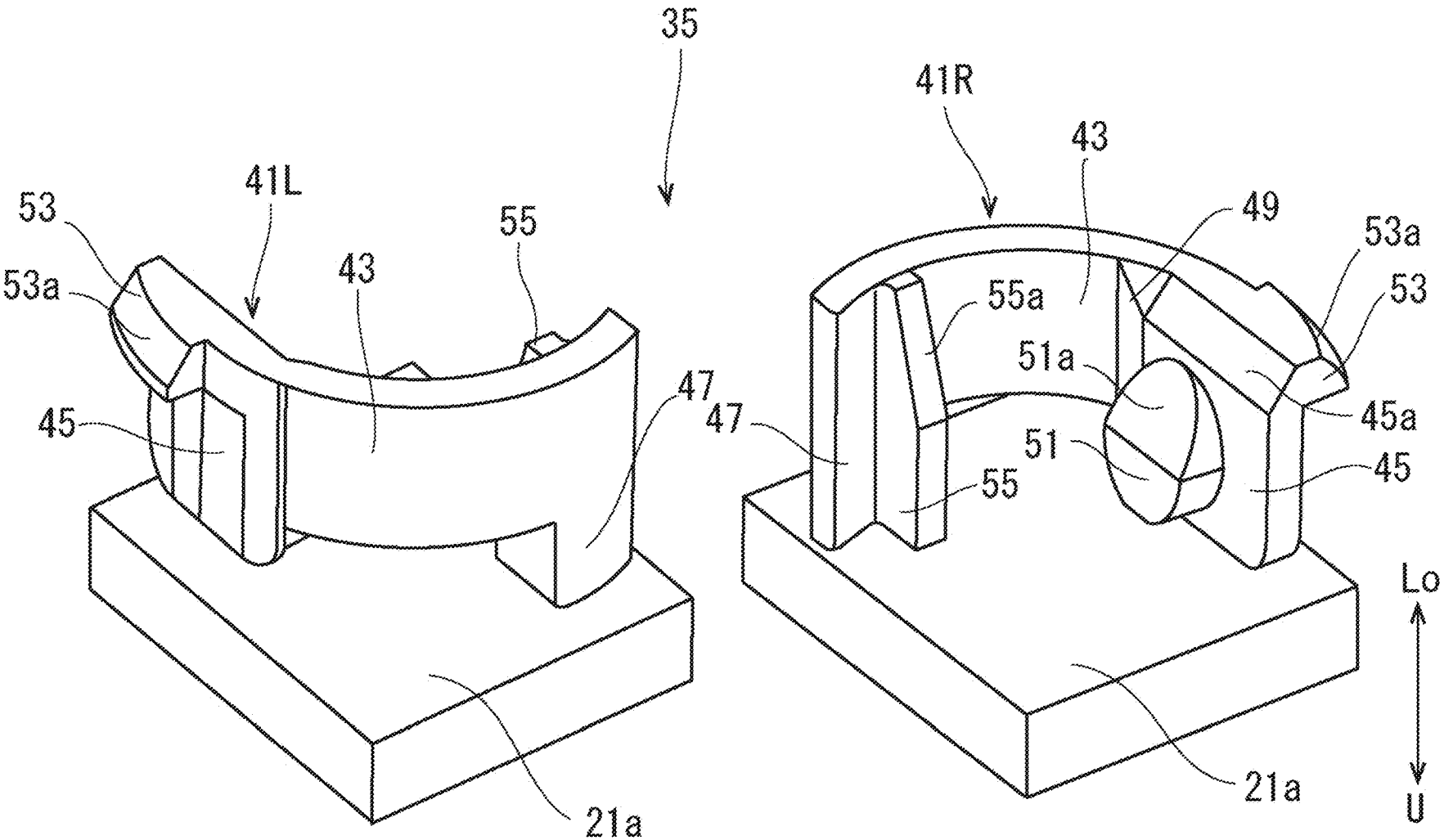
FIG. 4A includes perspective views each showing a rotation shaft of the sheet feeding tray according to the embodiment of the disclosure.
Figure 4B:
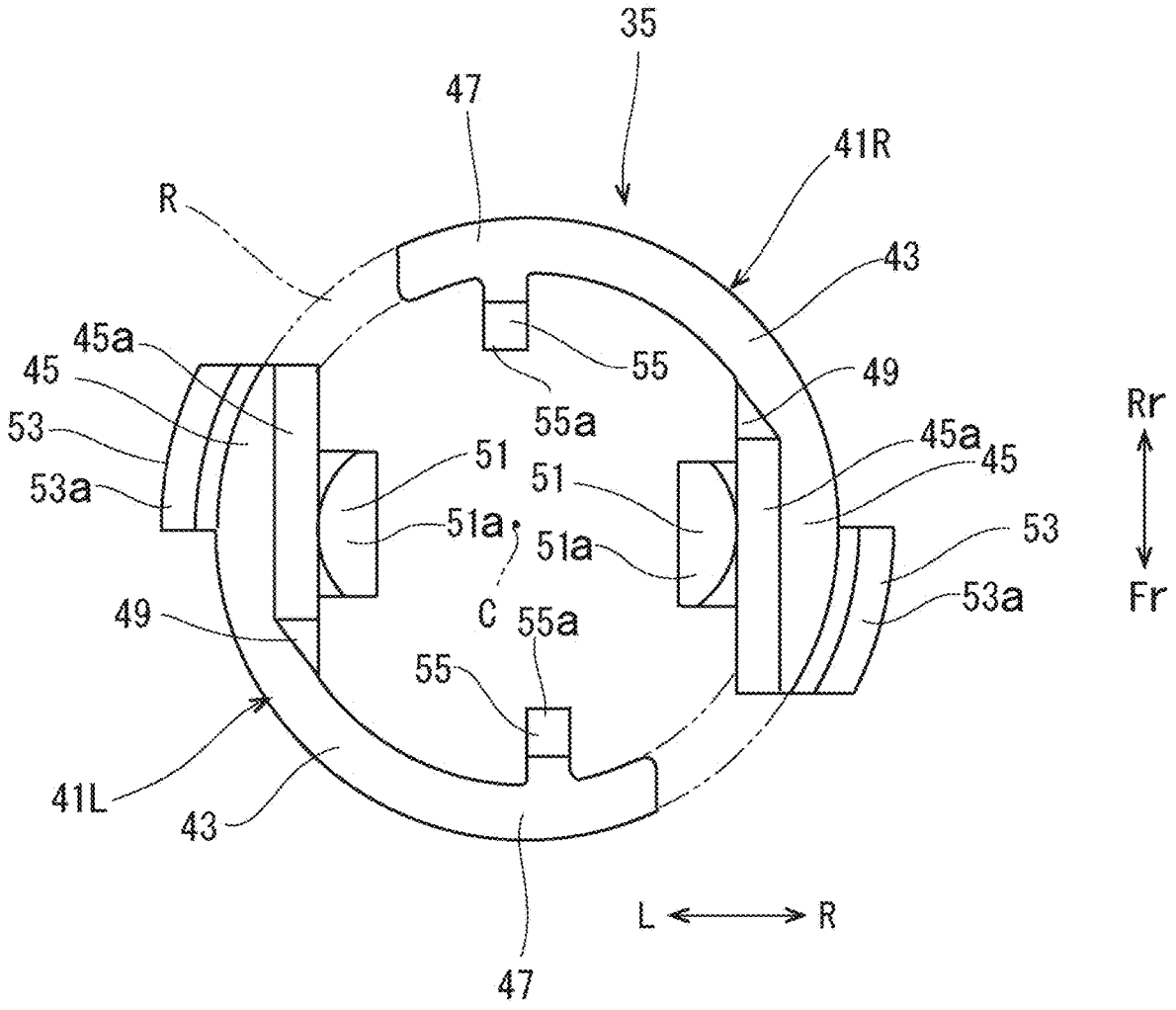
FIG. 4B is a plan view showing the rotation shaft of the sheet feeding tray according to the embodiment of the disclosure.
Figure 5:
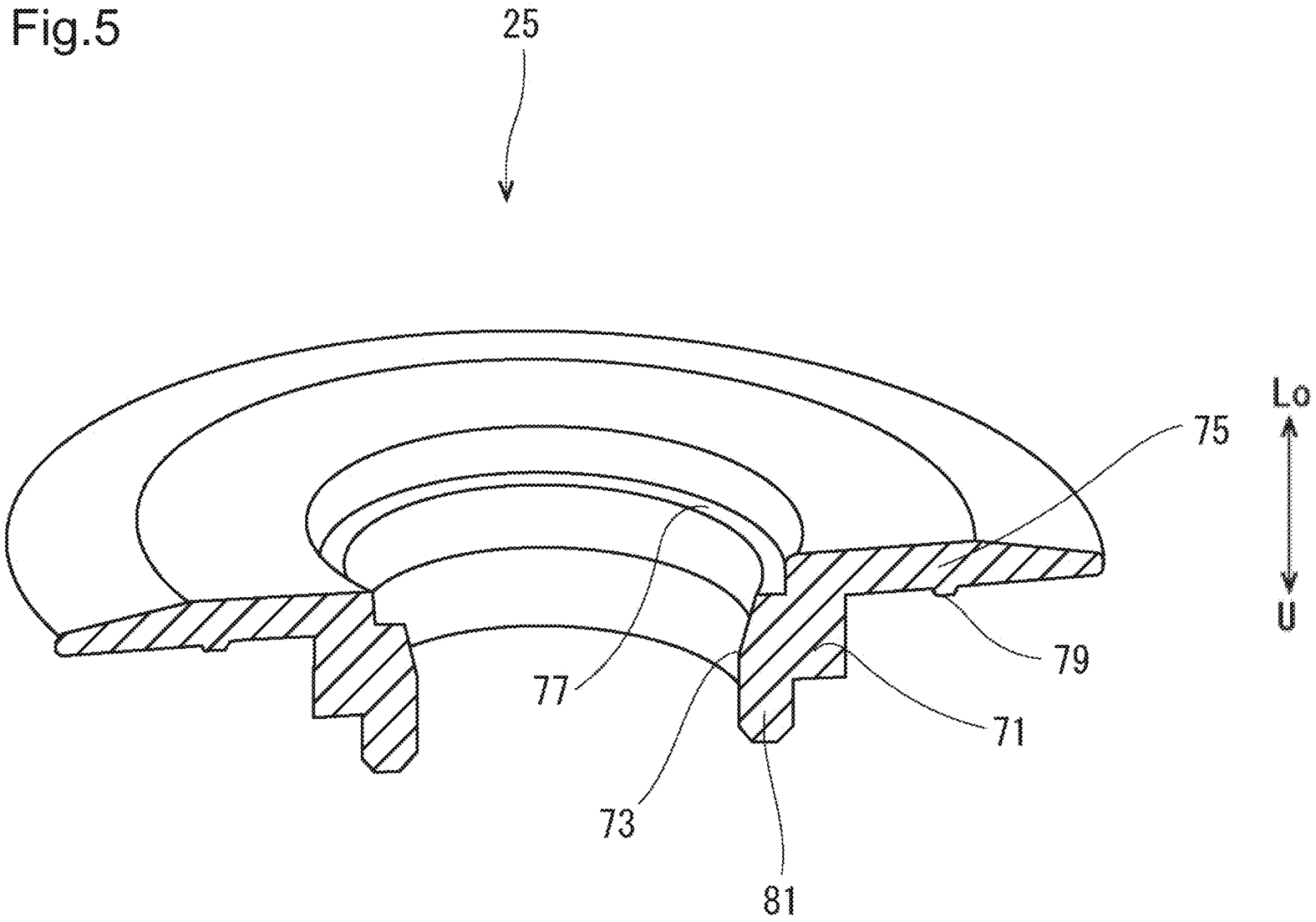
FIG. 5 is a partially cut-away perspective view showing a pinion gear of the sheet feeding tray according to the embodiment of the disclosure.

The sheet feeding tray 11 will be described hereunder, with reference to FIG. 2, FIG. 3, FIG. 4A and FIG. 4B, and also FIG. 5. FIG. 3 is an exploded perspective view showing a table 21, and front and rear side cursors 23F, 23R. FIG. 4A and FIG. 4B each illustrate a rotation shaft 35. FIG. 5 is a partially cut-away perspective view showing a pinion gear 25.

The sheet feeding tray 11 includes a table 21 on which the document is placed, a front and a rear side cursor 23F, 23R (simply side cursor 23, when collectively referred to), a pinion gear 25, and a coil spring 27 (not shown in FIG. 2 to FIG. 5, to be subsequently described with reference to FIG. 6A and FIG. 6B).

The table 21 will be described hereunder, with reference to FIG. 3. The table 21 includes a generally rectangular upper plate 21*a*, and a side plate 21*b* formed along the periphery of the upper plate 21*a*. The right front corner portion of the upper plate 21*a* is cut away in a generally rectangular shape. The upper face of the upper plate 21*a* includes a flat document setting surface 21*x*, on which the document is placed. The document placed on the document setting surface 21*x* is delivered to the transport device 15, with a non-illustrated pickup roller provided thereon. The direction in which the document is delivered (in FIG. 3, from the right to the left) will hereinafter be referred to as sheet feeding direction. On the upper plate 21*a*, a pair of shallow recesses 31 of a rectangular shape are formed, with a spacing between each other in the width direction (in FIG. 3, the front-rear direction) intersecting the sheet feeding direction. The recesses 31 each include a slit 33, formed on the bottom portion so as to extend in the width direction. The table 21 is formed of a synthetic resin, such as an ABS resin.

On the back face (lower face) of the table 21, a rotation shaft 35 is provided between the pair of recesses 31. The rotation shaft 35 supports the pinion gear 25 and the coil spring 27, as will be subsequently described. The rotation shaft 35 will be described hereunder, with reference to FIG. 4A and FIG. 4B. FIG. 4A includes perspective views each showing the rotation shaft 35, seen from below. FIG. 4B is a plan view showing the rotation shaft 35, seen from below. The rotation shaft 35 is formed as a unified part of the upper plate 21*a* of the table 21.

The rotation shaft 35 includes a left and a right divided part 41L, 41R (simply divided part 41, when collectively referred to), formed by dividing a circular cylinder R (see FIG. 4B) into two parts, along the circumferential direction. The left and right divided parts 41L, 41R are point-symmetrically located with respect to the center C of the circular cylinder R, in a plan view. The divided parts 41L, 41R each include a cylindrical portion 43 having a generally semicircular cylindrical shape, and a first leg 45 and a second leg 47, formed on the respective end portions of the cylindrical portion 43 in the circumferential direction, and fixed to the back face of the upper plate 21*a*. The first leg 45 is longer in the circumferential direction, than the second leg 47.

The first leg 45 includes an inner circumferential surface, formed as a flat plane parallel to the axial direction of the circular cylinder R, and is thicker than the cylindrical portion 43. Accordingly, a sloped portion 49 is formed between the inner circumferential surface of the first leg 45 and the inner circumferential surface of the cylindrical portion 43. On the distal end portion of the inner circumferential surface of the first leg 45, a sloped surface 45*a* is formed. In addition, the first leg 45 includes a column-shaped boss 51, protruding inward in the radial direction of the circular cylinder R, from the inner circumferential surface. The boss 51 includes a sloped surface 51*a*, formed on the side face so as to extend in the direction opposite to the upper plate 21*a*. The first leg 45 also includes a hook 53, protruding radially outward from the distal end portion of the outer circumferential surface (end portion on the opposite side of the upper plate 21*a*). Between the outer circumferential surface and the distal end portion of the hook 53, a sloped surface 53*a* is formed. Apart of the outer circumferential surface of the first leg 45, on the side of the upper plate 21*a* with respect to the hook 53, is formed as a flat plane parallel to the axial direction.

On the inner circumferential surface of the second leg 47, a rib 55 is formed so as to extend in the axial direction. Between the inner circumferential surface and the distal end face of the rib 55, a sloped surface 55*a* is formed.

As shown in FIG. 4B, the left and right divided parts 41L, 41R are located such that the bosses 51 oppose each other in the left-right direction, and the legs 45, 47 are fixed to the back face of the upper plate 21*a* of the table 21. As shown in FIG. 4A, a gap is defined between the upper plate 21*a* and the cylindrical portion 43.

The front and rear side cursors 23F, 23R will now be described, with reference to FIG. 3. The front and rear side cursors 23F, 23R serve to align the documents placed on the document setting surface 21*x*, at the central position in the width direction. The side cursor 23 is generally vertically erected from the document setting surface 21*x*, and includes an upright portion 61 extending parallel to the sheet feeding direction, and a base portion 63 bent generally at right angle from the lower end portion of the upright portion 61, and extending parallel to the upper plate 21*a*. On the inner surface of the upright portion 61 (surfaces of the respective upright portions 61 opposing each other), a regulating piece 65, for pressing the upper face of the documents placed on the document setting surface 21*x*, is provided. On the lower face of the base portion 63, a rib-shaped protrusion 67 is formed so as to extend in the width direction.

The base portion 63 of the side cursor 23 is fitted in the recess 31 (see FIG. 2) formed in the upper plate 21*a* of the table 21, such that the rib-shaped protrusion 67 is inserted in the slit 33. Accordingly, as shown in FIG. 2, the side cursor 23 is supported by the table 21 so as to move in the width direction, with the rib-shaped protrusion 67 being guided along the slit 33, in the width direction.

Referring again to FIG. 3, a rack gear 69 extending in the width direction is fixed to the rib-shaped protrusion 67 of the side cursor 23, protruding downward through the slit 33 of the upper plate 21*a* of the table 21. The rack gear 69 of the front cursor 23F includes rack teeth formed on the end face on the downstream side in the sheet feeding direction (left end face). The rack gear 69 of the rear cursor 23R includes rack teeth formed on the end face on the upstream side in the sheet feeding direction (right end face).

Referring now to FIG. 5, the pinion gear 25 will be described hereunder. The pinion gear 25 includes a gear portion 71 to be meshed with the rack gear 69 of the side cursor 23. The diameter of a shaft hole 73 of the gear portion 71 is slightly larger than the outer diameter of the rotation shaft 35 (outer diameter of the cylindrical portions 43 of the divided parts 41). The shaft hole 73 of the gear portion 71 accommodates thereinside the rotation shaft 35. The shaft hole 73 is formed such that the inner diameter becomes gradually larger, from the center in the axial direction toward the lower end portion.

On the lower end portion of the gear portion 71, a flange portion 75 is formed so as to protrude in the radial direction of the shaft hole 73. The flange portion 75 is larger in inner diameter, than the shaft hole 73. Accordingly, a stepped portion 77 is formed between the inner circumferential surface of the shaft hole 73 and the inner circumferential surface of the flange portion 75. The back face of the flange portion 75 (on the side of the gear portion 71) is formed as a flat plane perpendicular to the axial direction. In addition, such back face includes a rib 79, extending along the circumferential direction. The front face of the flange portion 75 (opposite side to the gear portion 71) is inclined in stages, so as to be thinner toward the radially outer side. On the upper end face of the gear portion 71 in the axial direction (opposite side to the flange portion 75), an annular portion 81 is formed along the periphery of the shaft hole 73.

The distal end portion of the annular portion 81 has an arcuate shape, in a cross-sectional view. The pinion gear 25 is formed of a highly slidable material, such as POM.

The coil spring 27 will now be described. The coil spring 27 is, in its natural state, longer than the inner diameter of the rotation shaft 35 (inner diameter of the cylindrical portions 43 of the divided parts 41).

Figure 6A:
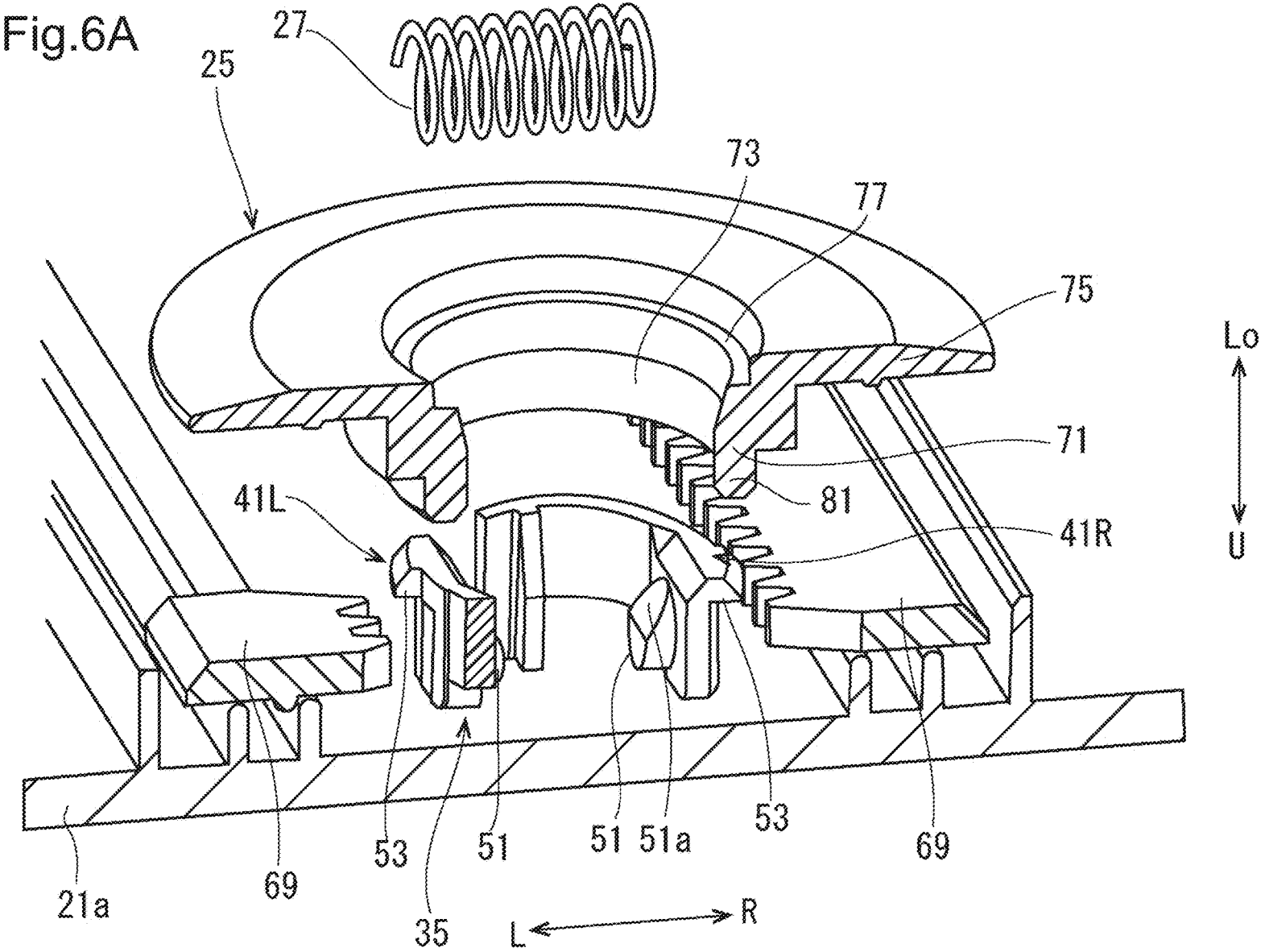
FIG. 6A is a partially cut-away perspective view showing the rotation shaft to which a pinion gear and a coil spring are yet to be attached, in the sheet feeding tray according to the embodiment of the disclosure.
Figure 6B:
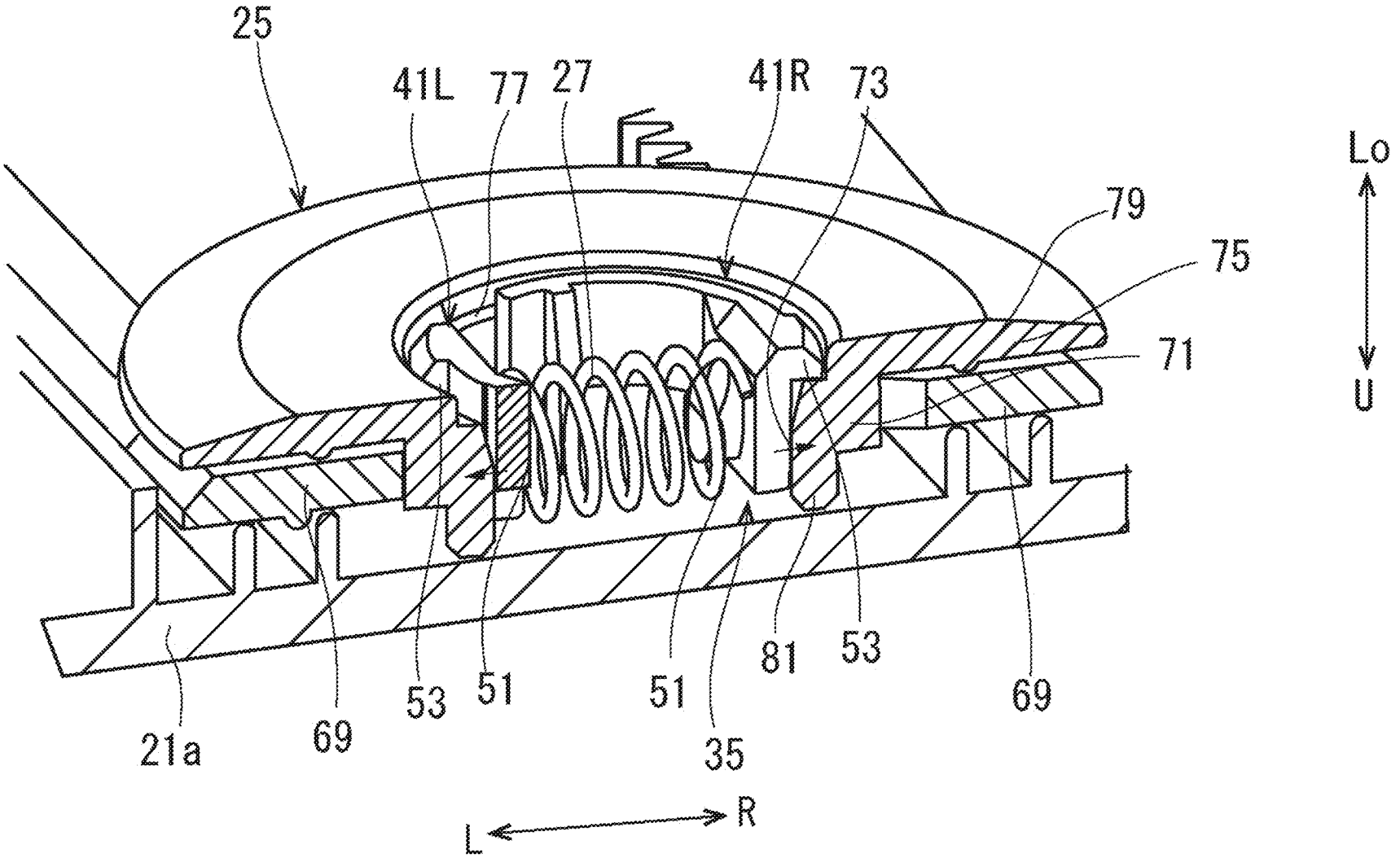
FIG. 6B is a partially cut-away perspective view showing the rotation shaft to which the pinion gear and the coil spring have been attached, in the sheet feeding tray according to the embodiment of the disclosure.

Referring now to FIG. 6A and FIG. 6B, the process to fix the pinion gear 25 to the rotation shaft 35 will be described hereunder. FIG. 6A is a partially cut-away perspective view seen from below, showing the rotation shaft 35 to which the pinion gear 25 and the coil spring 27 are yet to be attached. FIG. 6B is a partially cut-away perspective view seen from below, showing the rotation shaft 35 to which the pinion gear 25 and the coil spring 27 have been attached. The front and rear side cursors 23F, 23R are located farthest from each other (only the rack gear 69 is shown in FIG. 6A and FIG. 6B).

First, as shown in FIG. 6A, the pinion gear 25 is retained such that the gear portion 71 is oriented upward and the flange portion 75 is oriented downward, and the rotation shaft 35 is inserted into the shaft hole 73 of the gear portion 71. In this process, when the annular portion 81 of the gear portion 71 is abutted against the sloped surface 53*a* (see FIG. 4A and FIG. 4B) of the hook 53 of the rotation shaft 35, the first leg 45 is pressed by the annular portion 81, so as to be elastically deformed to the inner side in the radial direction of the rotation shaft 35, against the biasing force of the coil spring 27, attached inside the divided parts 41L, 41R so as to press the same from inside toward the outside.

Then the rotation shaft 35 is further inserted into the shaft hole 73 of the pinion gear 25, with the teeth on the gear portion 71 of the pinion gear 25 and the rack teeth of the rack gear 69 meshed with each other. The hook 53 moves along the inner circumferential surface of the shaft hole 73, keeping the elastically deformed state. When the hook 53 is disengaged from the inner circumferential surface of the shaft hole 73 thereafter, the first leg 45 elastically returns to the outer position in the radial direction of the rotation shaft 35, owing to the pressing force of the coil spring 27. At this point, the hook 53 is engaged with the stepped portion 77 of the pinion gear 25. In addition, the annular portion 81 on the gear portion 71 of the pinion gear 25 makes contact with the back face of the upper plate 21*a*. Further, the annular rib 79 on the back face of the flange portion 75 makes contact with the lower face of the rack gear 69. Accordingly, the rack gear 69 is supported by the flange portion 75, from the lower side.

Thus, the pinion gear 25 is rotatably supported by the rotation shaft 35, and also restricted from coming off, by the rotation shaft 35. In addition, the pinion gear 25 is meshed with the rack gear 69. At this point, although the outer circumferential surface of the rotation shaft 35 is in contact with the inner circumferential surface of the shaft hole 73 of the pinion gear 25, no force is exerted to the pinion gear 25, in the radial direction.

Hereunder, the process of attaching the coil spring 27 between the respective bosses 51 of the left and right divided parts 41L, 41R will be described. To attach the coil spring 27 between the respective bosses 51 of the left and right divided parts 41L, 41R, first, an end portion of the coil spring 27 is fitted around one of the bosses 51, and then the other end portion of the coil spring 27 is squeezed along the sloped surface 51*a* (see also FIG. 4A and FIG. 4B) of the other boss 51. In this process, the coil spring 27 is gradually compressed. Then, when the other end portion of the coil spring 27 is aligned with the other boss 51, the coil spring 27 elastically recovers, and the other end portion thereof is fitted around the other boss 51. The coil spring 27 has not regained its natural length, but is compressed between the bosses 51. Therefore, the coil spring 27 biases the bosses 51, in other words the first legs 45, in the direction away from each other.

Figure 7:
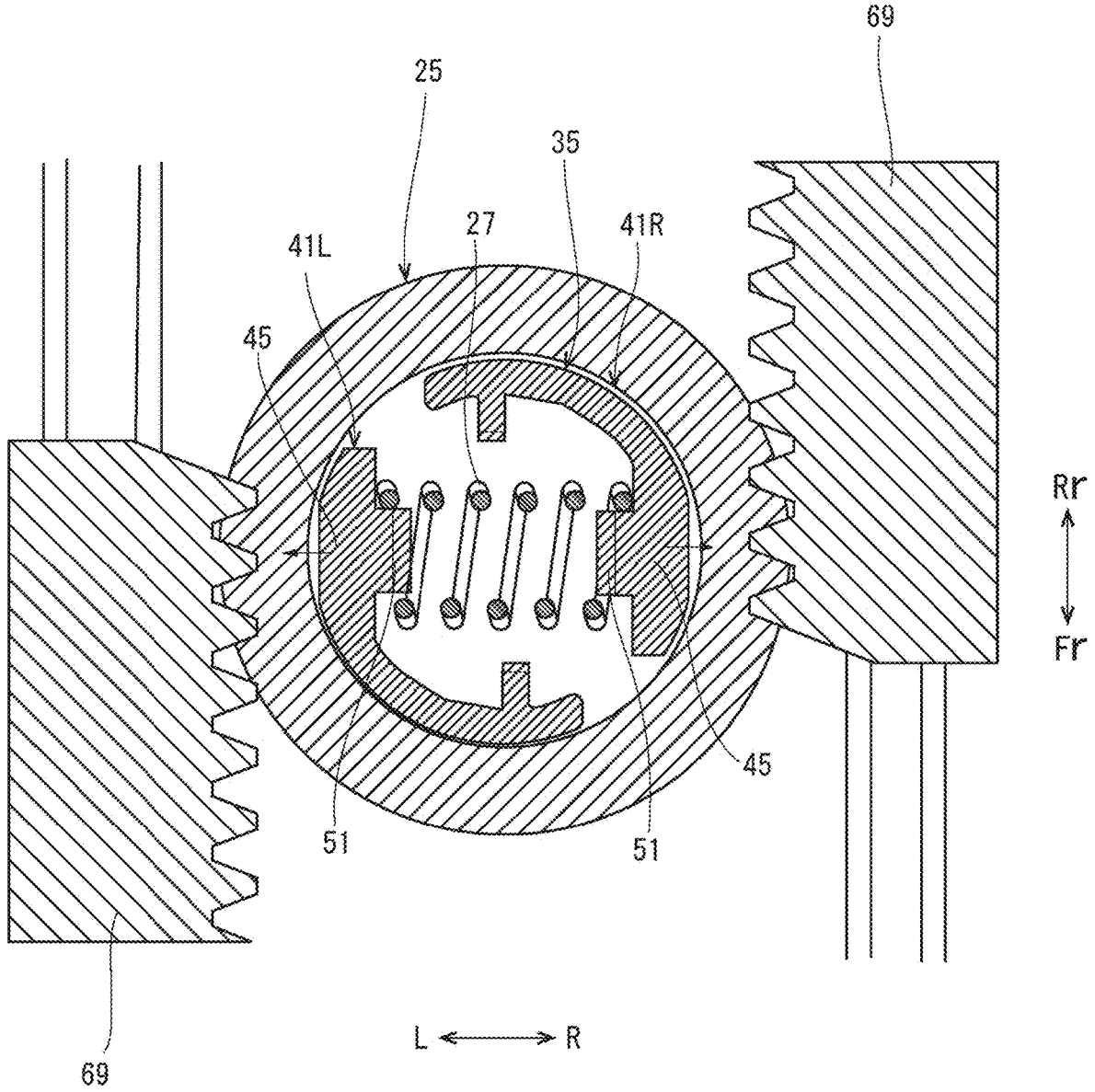
FIG. 7 is a cross-sectional view showing the pinion gear and a rack gear in the sheet feeding tray according to the embodiment of the disclosure.

As result, a radially outward force is exerted to the respective first legs 45 of the left and right divided parts 41L, 41R, as indicated by arrows in FIG. 6B and FIG. 7. The divided part 41 is a unified part of the table 21 formed of a resin, and is therefore elastically deformable. Accordingly, when the left and right divided parts 41L, 41R are subjected to the mentioned force, the divided parts 41L, 41R are elastically deformed radially outward, thereby bringing the outer circumferential surface of the first leg 45 into contact with the inner circumferential surface of the shaft hole 73 of the pinion gear 25. Therefore, a frictional force is generated between these circumferential surfaces, and the rotation of the pinion gear 25 with respect to the rotation shaft 35 is braked. The coil spring 27 exemplifies the biasing member in the disclosure, which biases the rotation shaft 35 in the direction for contacting the pinion gear 25.

However, as described earlier, a part of the outer circumferential surface of the first leg 45 is formed as a flat plane parallel to the axial direction of the rotation shaft 35 (see FIG. 7). Therefore, the frictional force between the circumferential surfaces, generated by the pressing force of the coil spring 27, is adjusted to such a level that does not inhibit the pinion gear 25 from rotating.

Hereunder, the document aligning operation, performed by the sheet feeding tray 11 configured as above, will be described. In the initial state, the front and rear side cursors 23F, 23R are located farthest from each other, in the width direction. The user positions the leading edge of the document at the prespecified position, and places the document on the document setting surface 21*x* of the sheet feeding tray 11. Then the user moves one of the side cursors 23 toward the side edge of the document. Accordingly, the rack gear 69 is made to move together with the one side cursor 23, and causes the pinion gear 25 to rotate. The rotation of the pinion gear 25 causes the rack gear 69 of the other side cursor 23 to move, so that the other side cursor 23 moves toward the other side edge of the document. Thus, the front and rear side cursors 23F, 23R are synchronically moved by an equal distance, and abutted against the respective side edges of the document. As result, the document is aligned at the center in the width direction.

When the pinion gear 25 rotates, the rotation of the pinion gear 25 is braked by the frictional force between the rotation shaft 35 biased by the coil spring 27, and the coil spring 27. Accordingly, it is difficult for the pinion gear 25 to rotate, after the side cursors 23 are set in position. In other words, the side cursors 23 are difficult to be moved. Therefore, the side cursors 23 are prevented from accidentally moving, while the user is setting the documents. Here, since the pressing force of the coil spring 27 is, as described above, not involved with the engaging strength between the gear portion 71 of the pinion gear 25 and the rack gear 69 of the side cursor 23, the pinion gear 25 can be smoothly made to rotate, by the movement of the side cursors 23.

According to this embodiment, as is apparent from the foregoing description, the pinion gear 25 and the rack gear 69 are not configured in advance so as to be deeply meshed with each other, and the rotation of the pinion gear 25 is braked by the elastic deformation of the rotation shaft 35 caused by the coil spring 27. Therefore, the side cursors 23 can be detained at the desired position with sufficient stability, and also can be smoothly moved.

Figure 8:
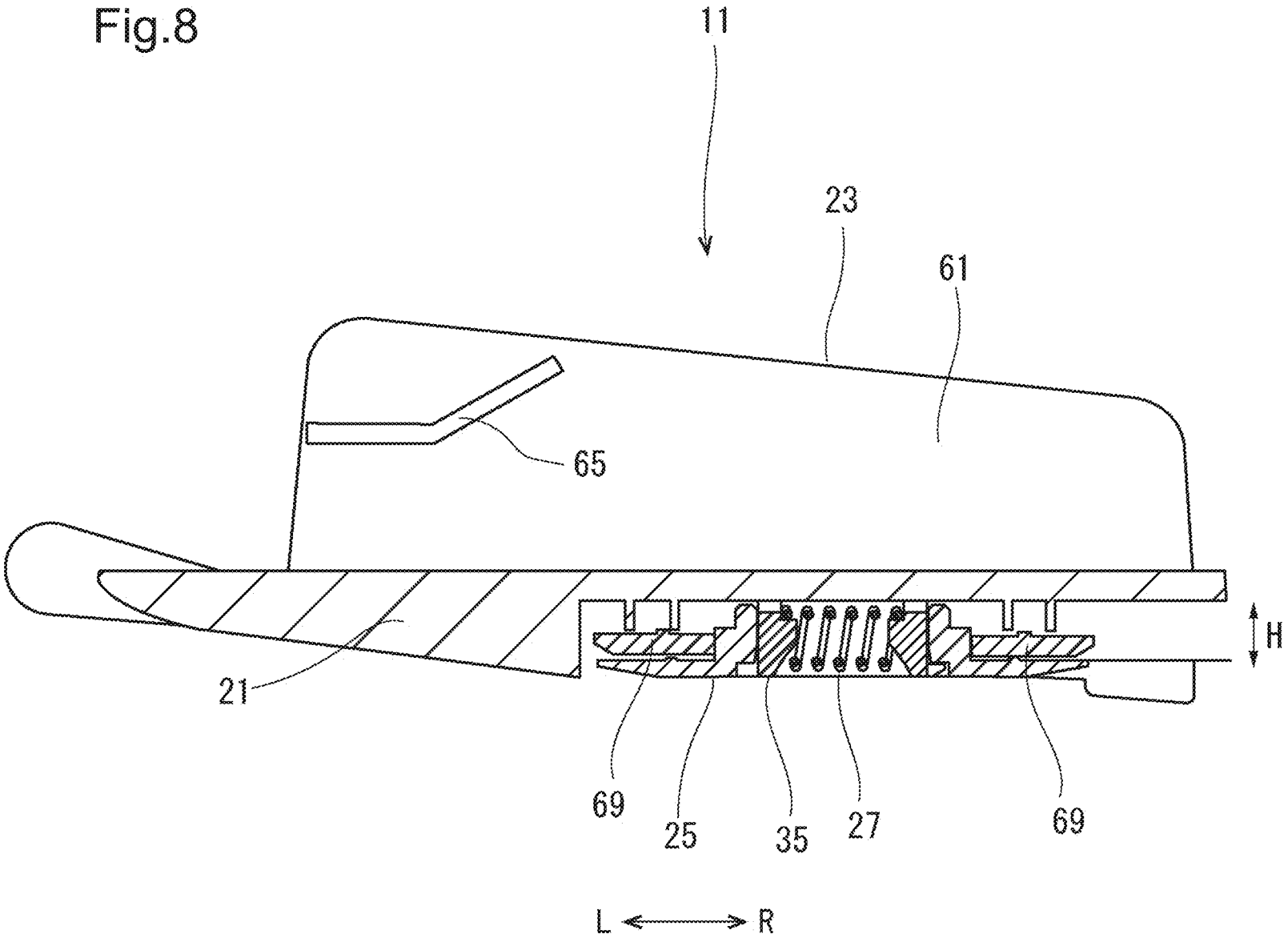
FIG. 8 is a cross-sectional view showing the sheet feeding tray according to the embodiment of the disclosure.

In addition, the rotation shaft 35 is directly fixed to the upper plate 21*a* of the table 21 of the sheet feeding tray 11, and the coil spring 27 is located in a hollow portion inside the rotation shaft 35. Therefore, the height H of the rack-and-pinion mechanism, the coil spring 27 inclusive (see FIG. 8) can be reduced, to make the sheet feeding tray 11 thinner as a whole.

Further, since the rotation shaft 35 is composed of the two divided parts 41, the rotation shaft 35 is easy to be radially deformed, upon being biased by the coil spring 27. Accordingly, the outer circumferential surface of the first leg 45 of the rotation shaft 35 can be surely brought into contact the inner circumferential surface of the shaft hole 73 of the pinion gear 25. In addition, the coil spring 27 is biasing the first leg 45 of the rotation shaft 35 in the direction in which the pinion gear 25 and the rack gear 69 are meshed with each other. Therefore, when the first leg 45 is biased, the pinion gear 25 is also biased, so that the pinion gear 25 and the rack gear 69 can be surely meshed with each other.

Further, since the pinion gear 25 is formed of a highly slidable material, the pinion gear 25 can smoothly rotate, with respect to the rotation shaft 35.

Although the side cursors 23 are provided on the sheet feeding tray 11 of the document transport unit 7 in the foregoing embodiment, such side cursors are also applicable to the non-illustrated sheet cassette for the image forming unit 3.

In the case of the existing rack-and-pinion mechanism, unlike the one according to the foregoing embodiment, the rack gear and the pinion gear become more deeply meshed with each other, when the side cursors have been set in position, to prevent the side cursors from being displaced after the positioning is done. Therefore, it may be difficult for some users to move the side cursors, or to smoothly move the side cursors.

With the configuration according to the foregoing embodiment, the mentioned drawbacks can be eliminated, so that the pair of side cursors can be smoothly moved.

While the present disclosure has been described in detail with reference to the embodiments thereof, it would be apparent to those skilled in the art that the various changes and modifications may be made therein within the scope defined by the appended claims.

What is claimed is:

1. A sheet feeding tray comprising:

a table on which a sheet to be supplied in a predetermined sheet feeding direction is placed;

a pair of side cursors supported by the table, so as to move in a width direction intersecting the sheet feeding direction;

a pair of rack gears respectively fixed to the pair of side cursors, and extending in the width direction;

a pinion gear meshed with the pair of rack gears;

a rotation shaft fixed to the table, and rotatably supporting the pinion gear, the rotation shaft being elastically deformable; and a biasing member that biases the rotation shaft in a direction for contacting the pinion gear.

2. The sheet feeding tray according to claim 1, wherein the rotation shaft has a circular cylindrical shape including a hollow portion, and inserted in a shaft hole of the pinion gear thereby rotatably supporting the pinion gear, and the biasing member is located in the hollow portion of the rotation shaft.

3. The sheet feeding tray according to claim 1, wherein the pinion gear is formed of a material including polyoxymethylene (POM).

4. The sheet feeding tray according to claim 1, wherein the rotation shaft is divided into two parts, in a circumferential direction.

5. The sheet feeding tray according to claim 1, wherein the rotation shaft is divided into two divided parts of an arcuate shape, in the circumferential direction, the biasing member is attached inside the two divided parts, and the biasing member is pressing the two divided parts from inside toward outside, the rotation shaft including the two divided parts is located inside the pinion gear of an annular shape, and the two divided parts are abutted against an inner surface of the pinion gear, by pressing force of the biasing member, thereby biasing the pinion gear from inside.

6. The sheet feeding tray according to claim 1, wherein the biasing member is biasing the rotation shaft, along a direction in which the pinion gear and the pair of rack gear are meshed with each other.

7. An image forming apparatus comprising:

a document transport unit including the sheet feeding tray according to claim 1, and configured to pick up the sheet from the sheet feeding tray and transport the sheet;

an image reading unit that reads an image of the sheet transported by the document transport unit; and an image forming unit that forms an image, on a basis of the image read by the image reading unit.

* * * * *